US011819096B2

(12) United States Patent
Ford et al.

(10) Patent No.: US 11,819,096 B2
(45) Date of Patent: Nov. 21, 2023

(54) SINGLE-PIECE WATCH BAND

(71) Applicant: ELC MANAGEMENT LLC, Melville, NY (US)

(72) Inventors: Thomas C. Ford, Los Angeles, CA (US); Brandon Little, New York, NY (US); Antoine Sandoz, New York, NY (US)

(73) Assignee: ELC Management LLC, Melville, NY (US)

( * ) Notice: Subject to any disclaimer, the term of this patent is extended or adjusted under 35 U.S.C. 154(b) by 160 days.

(21) Appl. No.: 17/348,277

(22) Filed: Jun. 15, 2021

(65) Prior Publication Data

US 2021/0386162 A1 Dec. 16, 2021

Related U.S. Application Data

(60) Provisional application No. 63/039,963, filed on Jun. 16, 2020.

(51) Int. Cl.
*A44C 5/00* (2006.01)
*A44C 5/24* (2006.01)

(52) U.S. Cl.
CPC ..... *A44C 5/24* (2013.01)

(58) Field of Classification Search
CPC .... A44C 5/24; A44C 5/22; A44C 5/20; A44C 5/243; A44C 5/246; G04B 37/1486; G04B 37/16; G04B 37/18; Y10T 24/4782
USPC ..... 224/171; 368/282
See application file for complete search history.

(56) References Cited

U.S. PATENT DOCUMENTS

| | | | |
|---|---|---|---|
| 1,892,281 | A | 12/1932 | Kestenman |
| 2,159,857 | A | 5/1939 | Mix |
| 2,400,222 | A | 5/1946 | Cline |
| 2,432,661 | A | 12/1947 | Friedman |
| 2,439,274 | A | 4/1948 | Spector |

(Continued)

FOREIGN PATENT DOCUMENTS

| | | | |
|---|---|---|---|
| CH | 319691 | A | 2/1957 |
| CH | 680327 | A | 8/1992 |

(Continued)

OTHER PUBLICATIONS

International Search Report and Written Opinion for International Patent Application No. PCT/US2021/037351, dated Oct. 1, 2021 (16 pages).

*Primary Examiner* — Jack W Lavinder
(74) *Attorney, Agent, or Firm* — Goodwin Procter LLP

(57) ABSTRACT

The application describes a watch band and methods of manufacture and use thereof. In various embodiments, the watch band includes a first portion and a second portion continuous with the first portion. The first portion can be made of a first material and be adapted to be located directly under a back of a watch case. The second portion can include a series of rigid links formed from a second material that is different than the first material. The second portion can be adapted to wrap around the wrist of a user. In various embodiments, the watch band can feature offset links to enable the watch band to curl around a user's wrist while maintaining the watch case at a low profile above the first portion. In some cases, the watch band can include a detachment mechanism remote from where the watch band attaches to the watch case.

24 Claims, 10 Drawing Sheets

(56) References Cited

U.S. PATENT DOCUMENTS

| | | | |
|---|---|---|---|
| 2,453,616 | A | 11/1948 | Berstell |
| 2,653,442 | A | 9/1953 | Kupchick |
| 2,895,658 | A | 7/1959 | Dzus |
| 3,361,311 | A | 1/1968 | Sartarelli |
| 3,673,795 | A | 7/1972 | Nielson |
| 3,706,404 | A | 12/1972 | Campbell |
| 4,314,389 | A | 2/1982 | Sauer et al. |
| 4,458,478 | A | 7/1984 | North |
| 4,675,955 | A | 6/1987 | Nakamura |
| 4,742,503 | A | 5/1988 | Braun et al. |
| 4,845,694 | A | 7/1989 | Vuilleumier |
| 4,964,092 | A | 10/1990 | Brida |
| 4,979,276 | A | 12/1990 | Chimento |
| 5,175,912 | A | 1/1993 | Chevalley et al. |
| 5,187,838 | A | 2/1993 | Fontana |
| 5,215,235 | A | 6/1993 | Maekawa et al. |
| 5,305,617 | A | 4/1994 | Fontana |
| 5,333,123 | A | 7/1994 | Plancon et al. |
| 5,668,784 | A | 9/1997 | Iguchi |
| 5,711,056 | A | 1/1998 | Taguchi et al. |
| 5,771,543 | A | 6/1998 | Froidevaux et al. |
| 5,787,554 | A | 8/1998 | Hashimoto |
| 6,073,821 | A | 6/2000 | Mercer et al. |
| 6,289,562 | B1 | 9/2001 | Linder et al. |
| 6,415,483 | B1 | 7/2002 | Dang |
| 6,597,638 | B2 | 7/2003 | Droux |
| 6,905,240 | B2 | 6/2005 | Yokosuka |
| 6,921,006 | B2 | 7/2005 | Bauer |
| 6,964,153 | B2 | 11/2005 | So et al. |
| D543,122 | S | 5/2007 | Lafever et al. |
| 7,337,541 | B2 | 3/2008 | Grossiord et al. |
| D566,579 | S | 4/2008 | Tran |
| 7,430,787 | B2 | 10/2008 | Loetscher |
| 7,591,581 | B2 | 9/2009 | Lovegrove et al. |
| 7,618,260 | B2 | 11/2009 | Daniel et al. |
| 7,861,383 | B2 | 1/2011 | Yamamoto |
| 7,874,722 | B2 | 1/2011 | Clarkson et al. |
| D653,564 | S | 2/2012 | Eida |
| 8,418,325 | B2 | 4/2013 | Lemosquet et al. |
| 8,477,981 | B2 | 7/2013 | Heck et al. |
| 8,790,004 | B2 | 7/2014 | Chatelain |
| 8,960,510 | B2 | 2/2015 | Bertucci |
| 8,973,399 | B2 | 3/2015 | Heiden et al. |
| 9,282,792 | B2 | 3/2016 | Mace et al. |
| 9,471,102 | B2 | 10/2016 | Townsend et al. |
| 9,498,029 | B2 | 11/2016 | Schooley et al. |
| 9,622,552 | B2 | 4/2017 | Pemberton |
| 9,781,984 | B2 | 10/2017 | Baranski et al. |
| 9,826,789 | B2 | 11/2017 | Dey et al. |
| 9,867,435 | B2 | 1/2018 | Lepore et al. |
| 9,980,539 | B2 | 5/2018 | Webb et al. |
| D835,522 | S | 12/2018 | Dietrich |
| 2002/0017539 | A1 | 2/2002 | Rota |
| 2002/0105860 | A1 | 8/2002 | Gensini |
| 2003/0182770 | A1 | 10/2003 | Koshoji |
| 2007/0000283 | A1 | 1/2007 | Murao et al. |
| 2007/0253290 | A1 | 11/2007 | Aire |
| 2011/0026368 | A1 | 2/2011 | Relyea |
| 2011/0107566 | A1* | 5/2011 | Nalley ..... A44C 5/24 24/490 |
| 2012/0240359 | A1 | 9/2012 | Kaltenrieder |
| 2014/0084033 | A1 | 3/2014 | Kellond et al. |
| 2014/0101899 | A1* | 4/2014 | Moille ..... A44C 5/185 24/265 WS |
| 2015/0040611 | A1 | 2/2015 | Olsen et al. |
| 2015/0164189 | A1* | 6/2015 | Wilson ..... A44C 5/14 224/164 |
| 2015/0342308 | A1 | 12/2015 | Wilson |
| 2016/0206056 | A1 | 7/2016 | Pluemer et al. |
| 2018/0220753 | A1 | 8/2018 | Cox |
| 2019/0022912 | A1 | 1/2019 | Rannoux et al. |
| 2020/0405017 | A1* | 12/2020 | Hu ..... G04B 37/1486 |

FOREIGN PATENT DOCUMENTS

| | | | |
|---|---|---|---|
| CH | 705839 | A2 | 6/2013 |
| CH | 712004 | A2 | 7/2017 |
| CN | 202189236 | U | 4/2012 |
| CN | 103251181 | A | 8/2013 |
| CN | 203673249 | U | 6/2014 |
| CN | 205353590 | U | 6/2016 |
| CN | 205432426 | U | 8/2016 |
| CN | 205988038 | U | 3/2017 |
| CN | 206710814 | U | 12/2017 |
| CN | 207969773 | U | 10/2018 |
| CN | 109907437 | A | 6/2019 |
| CN | 109924618 | A | 6/2019 |
| CN | 209167834 | U | 7/2019 |
| DE | 202006012832 | U1 | 10/2006 |
| DE | 102014015217 | A1 | 4/2016 |
| EP | 0116384 | A1 | 8/1984 |
| EP | 945083 | A1 | 9/1999 |
| EP | 1110470 | A2 | 6/2001 |
| EP | 1857008 | A1 | 11/2007 |
| EP | 3335584 | A1 | 6/2018 |
| FR | 2410452 | A1 | 6/1979 |
| FR | 2637469 | A1 | 4/1990 |
| GB | 923229 | A | 4/1963 |
| JP | S55148504 | A | 11/1980 |
| JP | H9234104 | A | 9/1997 |
| JP | 2000253913 | A | 9/2000 |
| JP | 2002277561 | A | 9/2002 |
| JP | 3477773 | B2 | 12/2003 |
| JP | 2004065705 | A | 3/2004 |
| JP | 2006034654 | A | 2/2006 |
| JP | 2007062180 | A | 3/2007 |
| JP | 2010035960 | A | 2/2010 |
| JP | 4746138 | B1 | 8/2011 |
| JP | 5354434 | B2 | 11/2013 |
| JP | 2017080605 | A | 5/2017 |
| KR | 101768130 | B1 | 8/2017 |
| RU | 2582885 | C1 | 4/2016 |
| WO | WO-2008035993 | A1 | 3/2008 |
| WO | WO-2008084881 | A1 | 7/2008 |
| WO | WO-2008122998 | A1 | 10/2008 |
| WO | WO-2015200332 | A1 | 12/2015 |
| WO | WO-2017032267 | A1 | 3/2017 |
| WO | WO-2018133315 | A1 | 7/2018 |
| WO | WO-2019097779 | A1 | 5/2019 |

* cited by examiner

1000

1100

SINGLE-PIECE WATCH BAND

CROSS-REFERENCE TO RELATED APPLICATION

This application claims priority to and the benefit of, and incorporates herein by reference in its entirety, U.S. Provisional Patent Application No. 63/039,963, which was filed on Jun. 16, 2020.

FIELD OF THE INVENTION

In various embodiments, the invention relates generally to watch bands and, more particularly, to single-piece watch bands.

BACKGROUND

Many conventional watch bands are two-piece watch bands having two separate band components. FIG. 1 illustrates one example of a conventional two-piece watch band 100. As shown in FIG. 1, in a conventional two-piece watch band, each separate band component includes a loop through which a removable portion (e.g., a spring-loaded pin) of a watch case lug is inserted. When the removable portions are secured within the lug, the separate watch band components are secured to the watch case and the watch can be worn by a user. However, such removal and re-attachment of the removeable portions to the watch case can require specific tools and can be inconvenient.

Another known type of watch band is the NATO watch band or strap. FIG. 2 illustrates an example conventional NATO watch band 200. As shown in FIG. 2, conventional NATO watch bands are made of a flexible, non-rigid material (e.g., a fabric) to allow the watch band to be easily inserted through the spring-loaded pins or through fixed lugs on a watch case. However, because this insertion technique relies upon the flexibility and non-rigidity of the NATO watch band, NATO watch bands are not made from rigid materials, which limits the types of materials and styles that can be offered by a NATO watch band.

An improved watch band that addresses the shortcomings of existing watch bands is needed.

SUMMARY

The present invention relates to an improved single-piece watch band assembly that can be formed from more rigid materials (e.g., a series of rigid links) than NATO bands. Several inventive features of the watch band described herein enable it to function better and provide more design and style choices than conventional watch bands.

In one aspect, embodiments of the invention relate to a watch band that includes a first portion and a second portion continuous with the first portion. The first portion is made from a first material, and is adapted to be located directly under a back of a watch case. The second portion includes a series of rigid links formed from a second material that is different than the first material and is adapted to wrap around the wrist of a user. In some embodiments, the first material of the first portion and the second material of the second portion may be a polymer, an elastomer, a metal, a fabric, a mesh, a composite material, and/or combinations thereof. In certain further embodiments, the first material of the first portion can be rubber and the second material of the second portion can be metal.

In some embodiments, the watch band can further include an attachment structure that attaches the first portion of the watch band to the second portion of the watch band. The attachment structure can be at least one offset link. In such embodiments, the offset link can be adapted to couple to a lug of the watch case to prevent relative sliding movement therebetween. In further embodiments, the offset link can be a pair of offset links, each offset link adapted to couple to a respective lug of the watch case.

In some embodiments, the second portion of the watch band can include a detachment component that is disposed remotely from the first portion of the watch band. In such embodiments the watch band can further include a sizing component that is different than the detachment component. The sizing component can be a butterfly clasp in certain embodiments.

In another aspect, embodiments of the invention relate to a method of manufacturing a watch band. The method can include forming a first portion of the watch band from a first material and forming a second portion of the watch band continuous with the first portion from a second material that is different than the first material. The first portion of the watch band is adapted to be located directly under a back of a watch case. The second portion of the watch band includes a series of rigid links and is adapted to wrap around the wrist of a user.

In some embodiments, the first material of the first portion and the second material of the second portion may be a polymer, an elastomer, a metal, a fabric, a mesh, a composite material, and/or combinations thereof. In some embodiments, the method can further include the step of forming an attachment structure that attaches the first portion of the watch band to the second portion of the watch band. The attachment structure can be at least one offset link. In such embodiments, the offset link can be adapted to couple to a lug of the watch case to prevent relative sliding movement therebetween. In further embodiments, the offset link can be a pair of offset links, each offset link adapted to couple to a respective lug of the watch case.

In some embodiments, the step of forming the second portion of the watch band can include incorporating a detachment component into the second portion of the watch band and disposed remotely from the first portion of the watch band. In such embodiments, the step of forming the second portion of the watch band can further include incorporating a sizing component into the second portion of the watch band that is different than the detachment component. The sizing component can be a butterfly clasp.

In another aspect, embodiments of the invention relate to a method of attaching a watch band to a watch case. The method can include obtaining the watch band and sliding the watch band through two lugs of the watch case. The obtained watch band can include a first portion and a second portion that is continuous with the first portion. The first portion can be made of a first material. The second portion can include a series of rigid links formed from a second material that is different than the first material. The watch band is slid through the two lugs of the watch case such that the first portion of the watch band is located directly under a back of the watch case, and such that the second portion of the watch band is adapted to wrap around a wrist of a user.

In some embodiments, the first material of the first portion and the second material of the second portion may be a polymer, an elastomer, a metal, a fabric, a mesh, a composite material, and/or combinations thereof. In some embodiments, the watch band further includes an attachment structure that attaches the first portion of the watch band to the second portion of the watch band. The attachment structure can be at least one offset link. In such embodiments, the method can include the step of coupling the offset link to a lug of the watch case to prevent relative sliding movement therebetween. In further embodiments, the offset link can be a pair of offset links and the coupling step can include coupling each offset link to a respective lug of the watch case.

In some embodiments, the second portion of the watch band can further include a detachment component disposed remotely from the first portion of the watch band. In such embodiments, the method can further include the step of detaching the detachment component, prior to the step of sliding the watch band through two lugs of the watch case. In further embodiments, the method can further include the step of attaching the detachment component after the step of sliding the watch band through two lugs of the watch case.

In some embodiments, the watch band can further include a sizing component that is different than the detachment component. In such embodiments, the sizing component can be a butterfly clasp.

BRIEF DESCRIPTION OF THE DRAWINGS

These and other features, aspects, and advantages of embodiments of the present invention will become better understood with regard to the following description, and accompanying drawings, where.

The figures depict various embodiments of the present invention for purposes of illustration only. One skilled in the art will readily recognize from the following discussion that alternative embodiments of the structures and methods illustrated herein can be employed without departing from the principles of the embodiments of the invention described herein.

DETAILED DESCRIPTION

Watch Band

Figure 1:
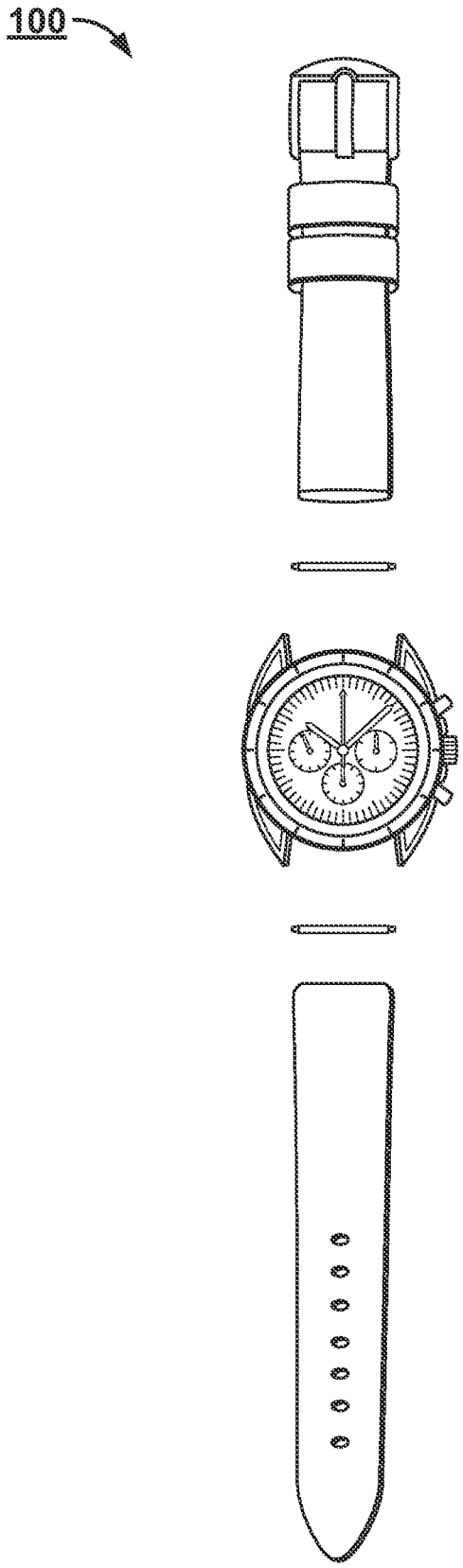
FIG. 1 (Prior Art)
FIG. 1 depicts an example of a conventional two-piece watch band.
Figure 2:
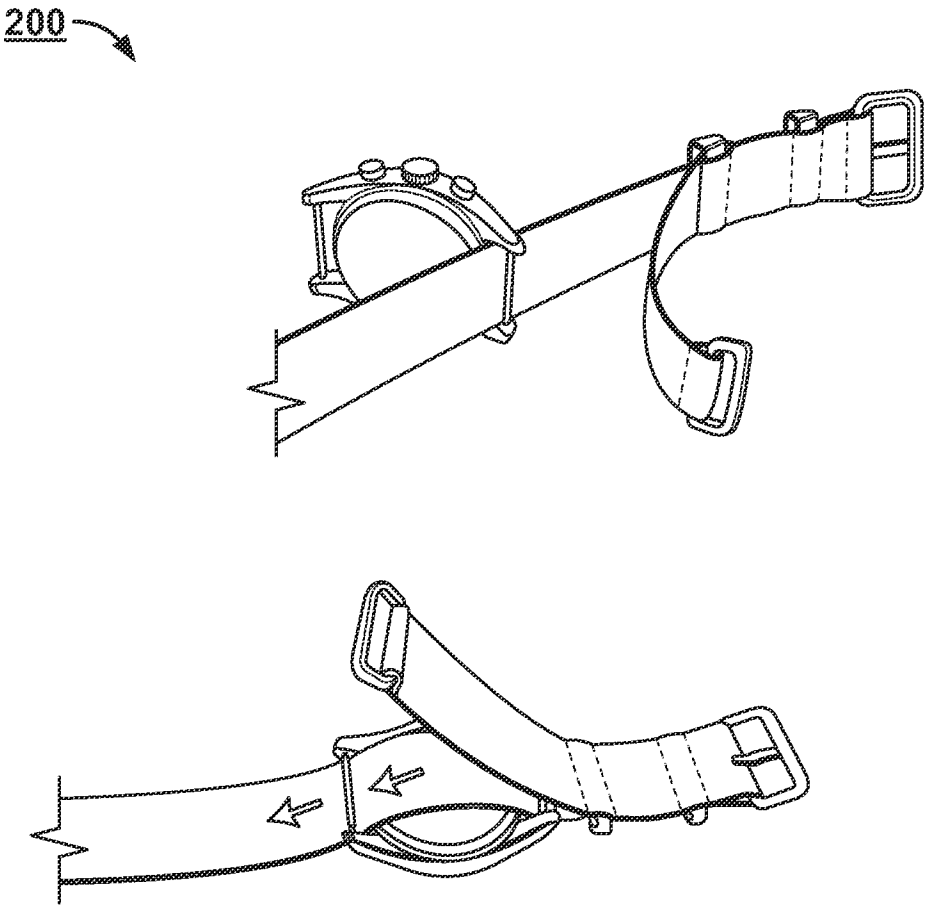
FIG. 2 (Prior Art)
FIG. 2 depicts an example of a conventional NATO watch band.
Figure 3:
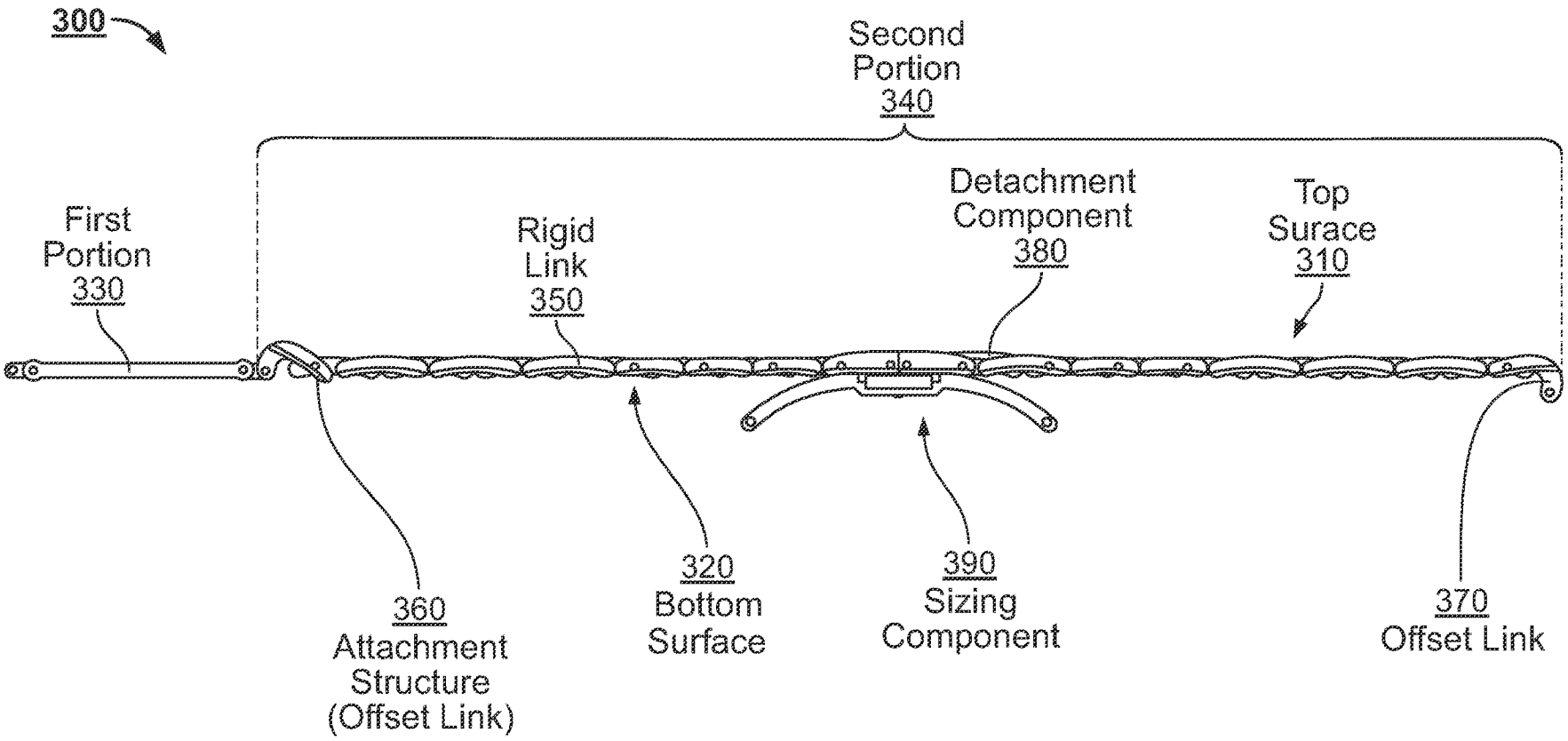
FIG. 3 is a schematic side view of a watch band, in accordance with various embodiments of the invention.

Embodiments of the invention include an improved watch band 300. FIG. 3 is a side view of the watch band 300, in accordance with various embodiments of the invention. The watch band 300 can include a top surface 310 and a bottom surface 320. As shown in FIG. 3, the watch band 300 can be a single, continuous band, and can include a first portion 330 attached to a second portion 340, such that the first portion 330 and the second portion 340 are continuous with one another. As used herein, the term single piece means that all of the components are attached such that no component has complete freedom of motion with respect to any other component. The term does not require that the structure be monolithic or be formed from a single component, but can be an assembly of components. The second portion 340 of the watch band 300 can include a series of rigid links, including example rigid link 350.

The first portion 330 of the watch band 300 is made of a first material and is adapted to be located directly under a back of a watch case 302, when the watch case 302 is attached to the watch band 300. The rigid links of the second portion 340 can be made of a second material that is different from the first material. The second portion 340 of the watch band 300 can be adapted to wrap around a wrist of a user when the watch band 300 is worn by the user. In some embodiments, the first material of the first portion 330 and the second material of the second portion 340 can be a polymer, an elastomer, a metal, a fabric, a mesh, a composite material, and/or any combination thereof. In certain further embodiments, the first material of the first portion 330 is rubber and the second material of the second portion 340 is metal. In embodiments in which the first material of the first portion 330 is a flexible material, such as rubber, the flexibility of the first material can enable the first portion 330 to conform to a wrist of a user, when the user wears the watch band 300, and also can enable the first portion 330 to be easily pulled through lugs of a watch case without becoming stuck.

The first portion 330 and the second portion 340 of the watch band 300 can be attached and be continuous with one another, such that the watch band 300 is a single, continuous piece not intended to be disassembled by a user. If a conventional rigid watch band were attempted to be pulled through two lugs of the watch case 302, that the watch band would not fit or would be too rigid to properly curl around a user's wrist and also permit the watch case 302 to lay flat against the wrist.

In some embodiments, such as the embodiment depicted in FIG. 3, an attachment structure 360 attaches the first portion 330 to the second portion 340. In such embodiments, the attachment structure 360 can be a pair of offset links 360, 370. The offset links 360, 370 can be adapted to couple to the lugs of a watch case when the watch case 302 is attached to the watch band 300. An example benefit of this configuration is to prevent relative sliding between the watch case 302 and the watch band 300. The offset links 360, 370 can have an arcuate (e.g., J-shape) profile which, when clasped to the watch case 302, can alter the trajectory of the watch band 300 such that it is better able to wrap around a user's wrist than if the offset links 360, 370 were not present. In general, any structure that alters the trajectory of the band 300 can be used instead of or in addition to the offset links 360, 370.

In some embodiments, the one or more offset links couple to the lugs of the watch case such that the first portion 330 of the watch band 300 is directed downwards and away from the watch case. This downward direction of the first portion 330 of the watch band 300 by the offset links enables the second portion 340 of the watch band 300 to be at the same level as the watch case when wrapped around a wrist of a user. This permits the first portion 330 of the watch band 300 to be neatly disposed below the watch case.

In some embodiments, e.g., depicted in FIG. 3, the second portion 340 of the watch band 300 can further include a detachment component 380 that is disposed remotely from the first portion 330 of the watch band 300. In other words, when the watch band 300 is attached to a watch case, the detachment component 380 enables the watch band 300 to be detached at a location remote from the watch case. This allows the watch band 300 to be pulled through the watch case lugs while permitting using a conventional technique for lengthening and shortening the watch band (e.g., a jeweler's or butterfly clasp) to facilitate donning and removal of the watch from a user's wrist. Conventional two-piece watch bands only have a detachment portion at the location where they attach to the watch case or where the slack is removed from the band. For a user to be able to direct the single-piece watch band 300 under the watch case, it can be advantageous for the watch band 300 to have a detachment point remote from the watch case and different from the sizing component. The detachment component 380 is depicted in further detail in FIG. 8.

In embodiments in which the second portion 340 of the watch band 300 further includes the detachment component 380, the watch band 300 can also include a sizing component 390 that is different than the detachment component 380. In general, any known sizing component can be used, e.g., a butterfly clasp.

Because the detachment component 380 is both disposed remotely from the first portion 300 of the watch band 300 and is different than the sizing component 390, the watch band 300 can be pulled through the lugs of a watch case for wear by a user before being sized to the user's wrist.

Figure 4:
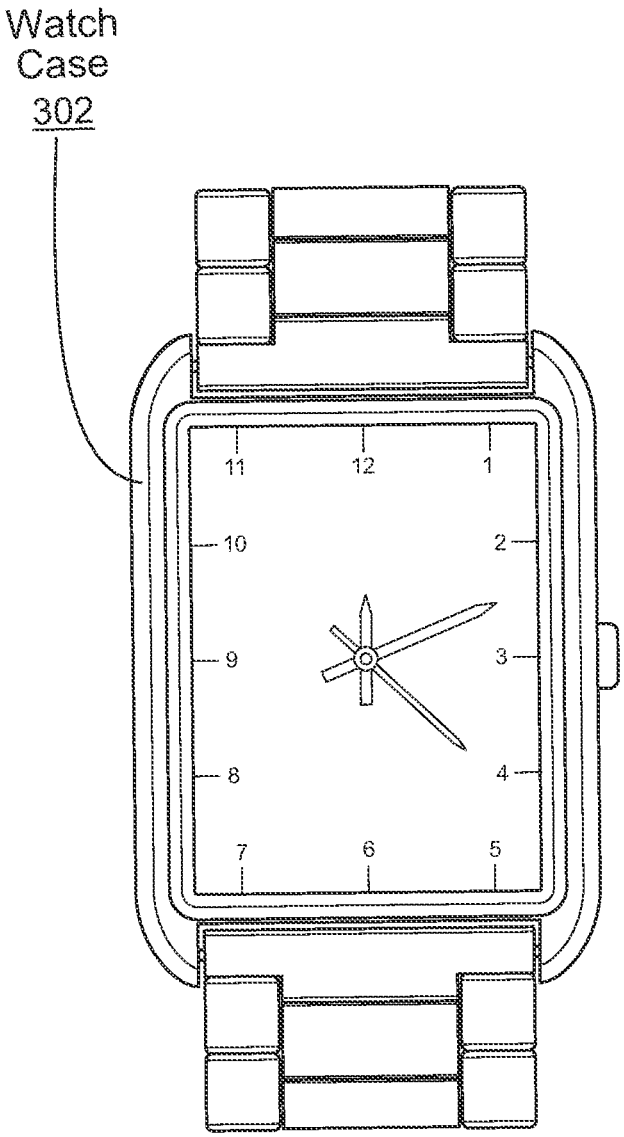
FIG. 4 is a schematic perspective view of the watch band attached to a watch case, in accordance with various embodiments of the invention.

FIG. 4 depicts a top surface of the watch band 300, in accordance with an embodiment of the invention when the watch band 300 is attached to a watch case 302.

Figure 5:
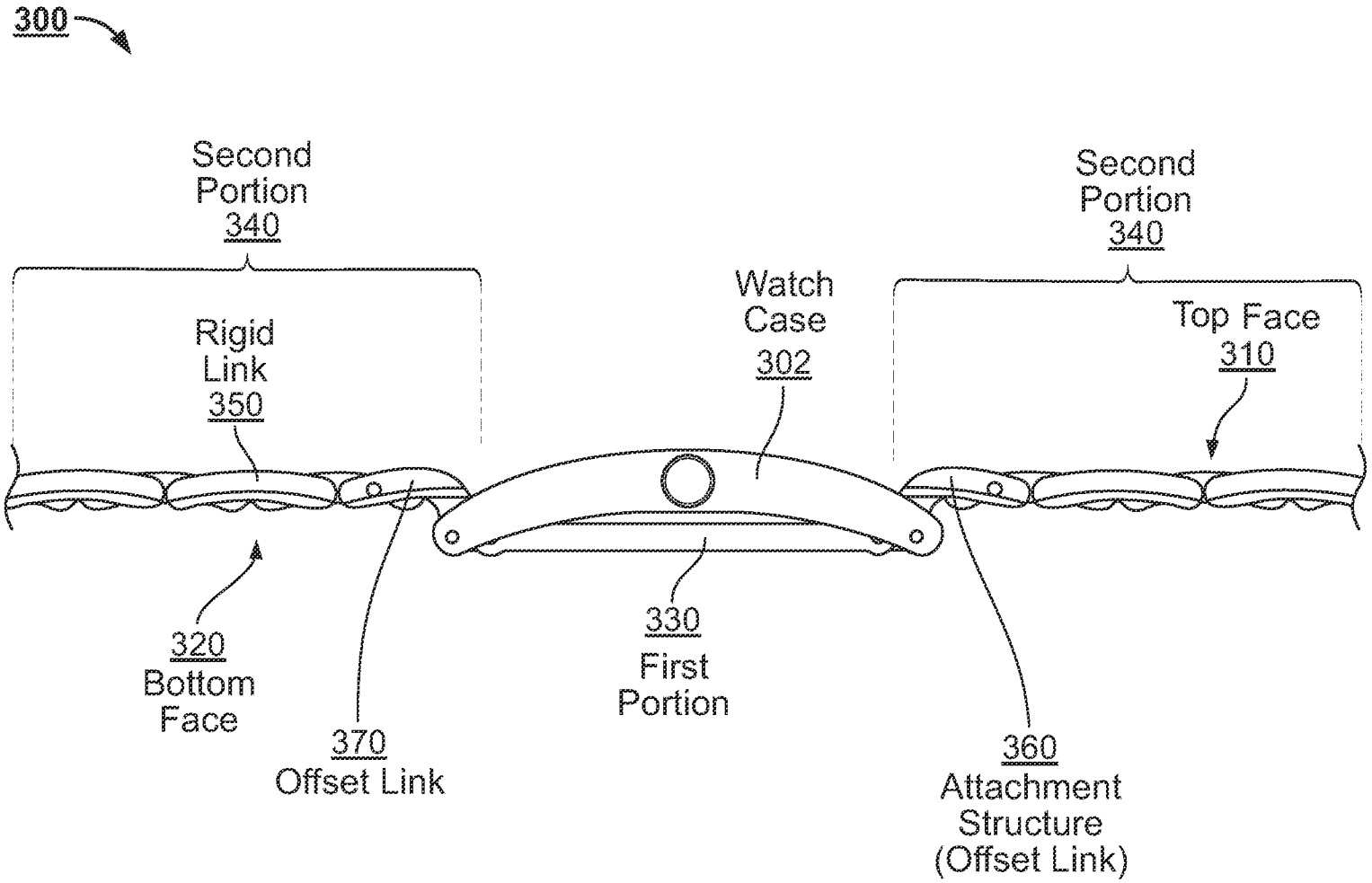
FIG. 5 is a schematic side view of the watch band attached to a watch case, in accordance with various embodiments of the invention.

FIG. 5 depicts a side view of the watch band 300 attached to the watch case 302, in accordance with an embodiment of the invention. The side view of the watch band 300 includes the features discussed above with regard to FIG. 3. Specifically, the side view of the watch band 300 includes a first portion 330, a second portion 340, an example rigid link 350, and an attachment structure comprising a pair of offset links 360 and 370. The attachment structure comprising the pair of offset links 360 and 370 to enables the watch band 300 to curl around a user's wrist while maintaining the watch case 302 at a low profile above the first portion 330.

Figure 6:
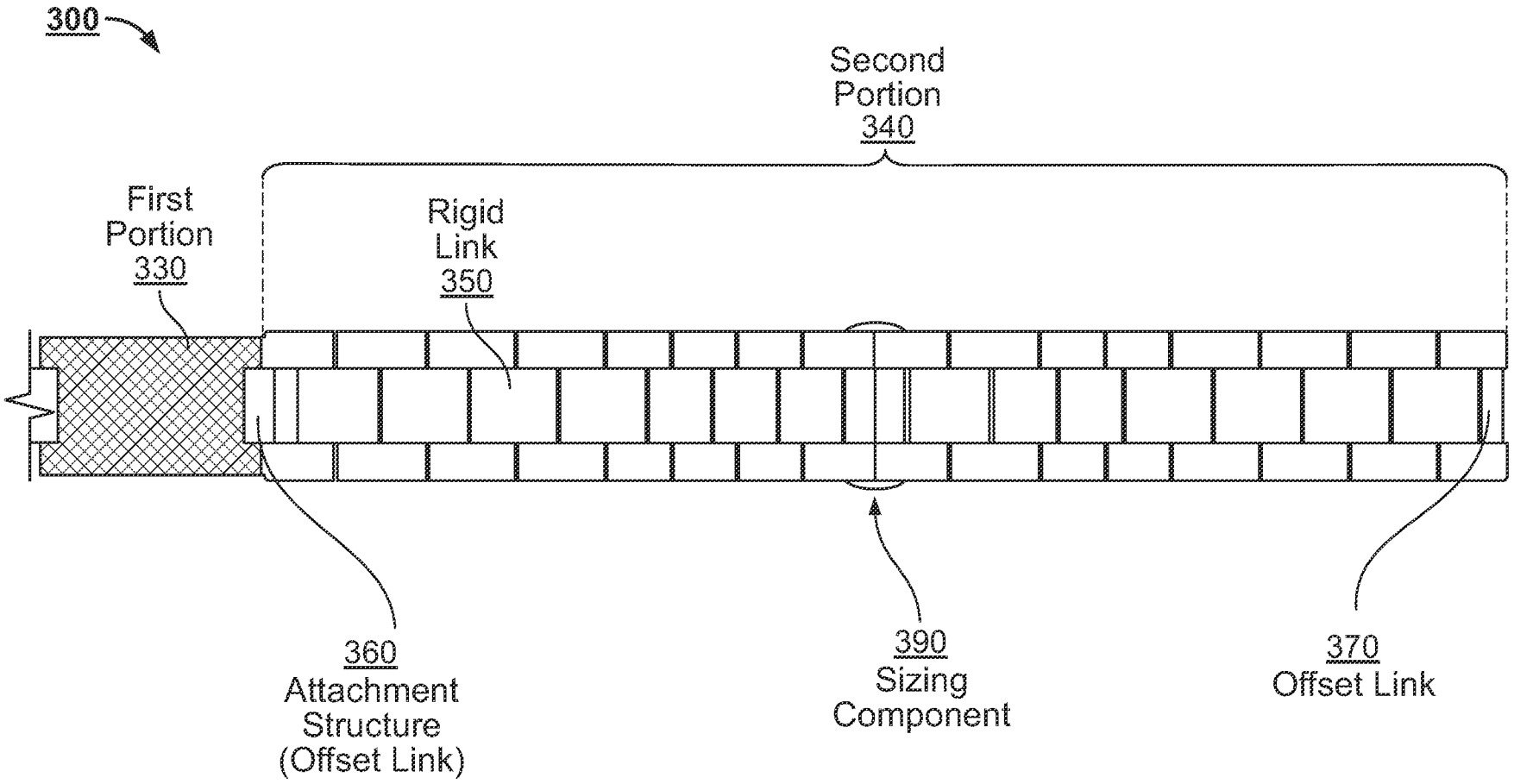
FIG. 6 is a schematic top view of the watch band, in accordance with various embodiments of the invention.

FIG. 6 depicts a top surface of the watch band 300, in accordance with an embodiment of the invention. The top surface of the watch band 300 includes the features discussed above with regard to FIG. 3. Specifically, the top surface of the watch band 300 includes a first portion 330, a second portion 340, an example rigid link 350, an attachment structure comprising a pair of offset links 360 and 370, and a sizing component 390.

Figure 7:
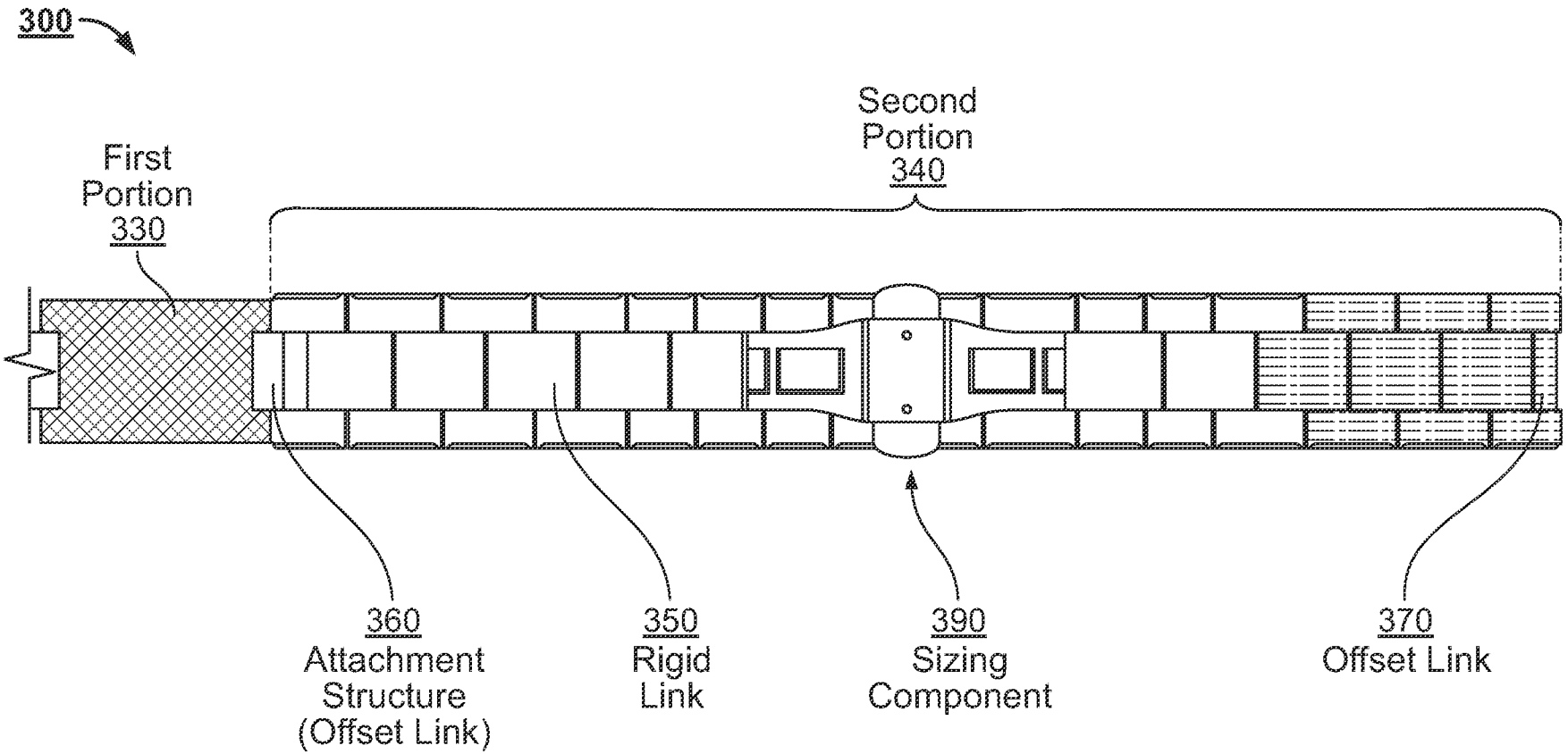
FIG. 7 is a schematic bottom view of the watch band, in accordance with various embodiments of the invention.

FIG. 7 depicts a bottom surface of the watch band 300, in accordance with an embodiment of the invention. The bottom surface of the watch band 300 includes the features discussed above with regard to FIG. 3. Specifically, the bottom surface of the watch band 300 shows the first portion 330, the second portion 340, the example rigid link 350 of the second portion 340, the pair of offset links 360 and 370, and the sizing component 390.

Figure 8:
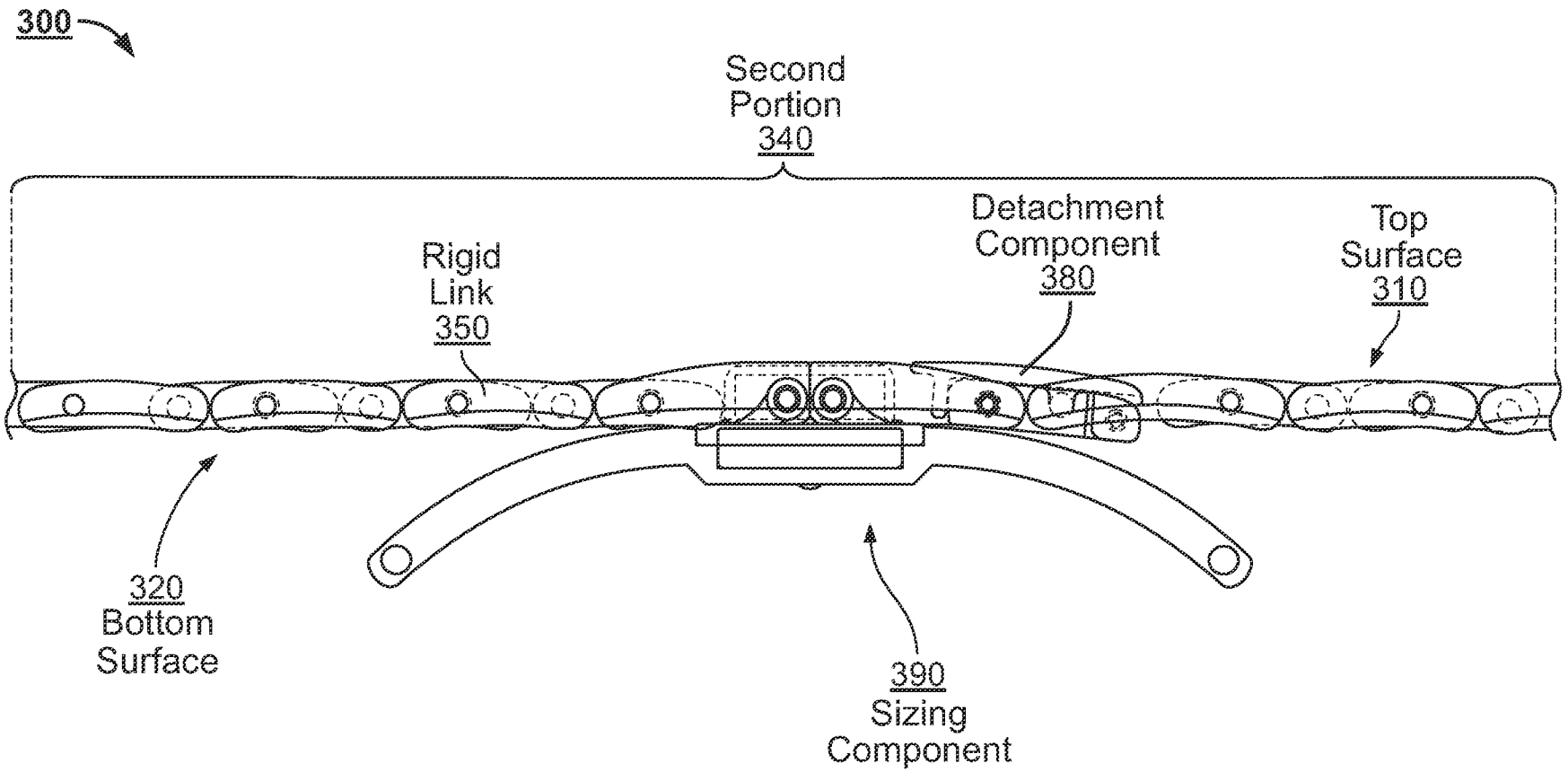
FIG. 8 is a schematic enlarged partial phantom side view of a detachment component, in accordance with various embodiments of the invention.

FIG. 8 is a an enlarged partial phantom side view of the watch band 300, in accordance with an embodiment of the invention. The phantom side view of the watch band 300 shows the features discussed above with regard to FIG. 3. Specifically, the phantom side view of the watch band 300 shows the top surface 310, the bottom surface 320, the second portion 340, the example rigid link 350 of the second portion 340, the detachment component 380, and the sizing component 390. The first portion of the watch band 300 is not visible in FIG. 8. In this embodiment, the detachment component 380 is a pivoting snap-style clasp.

Figure 9:
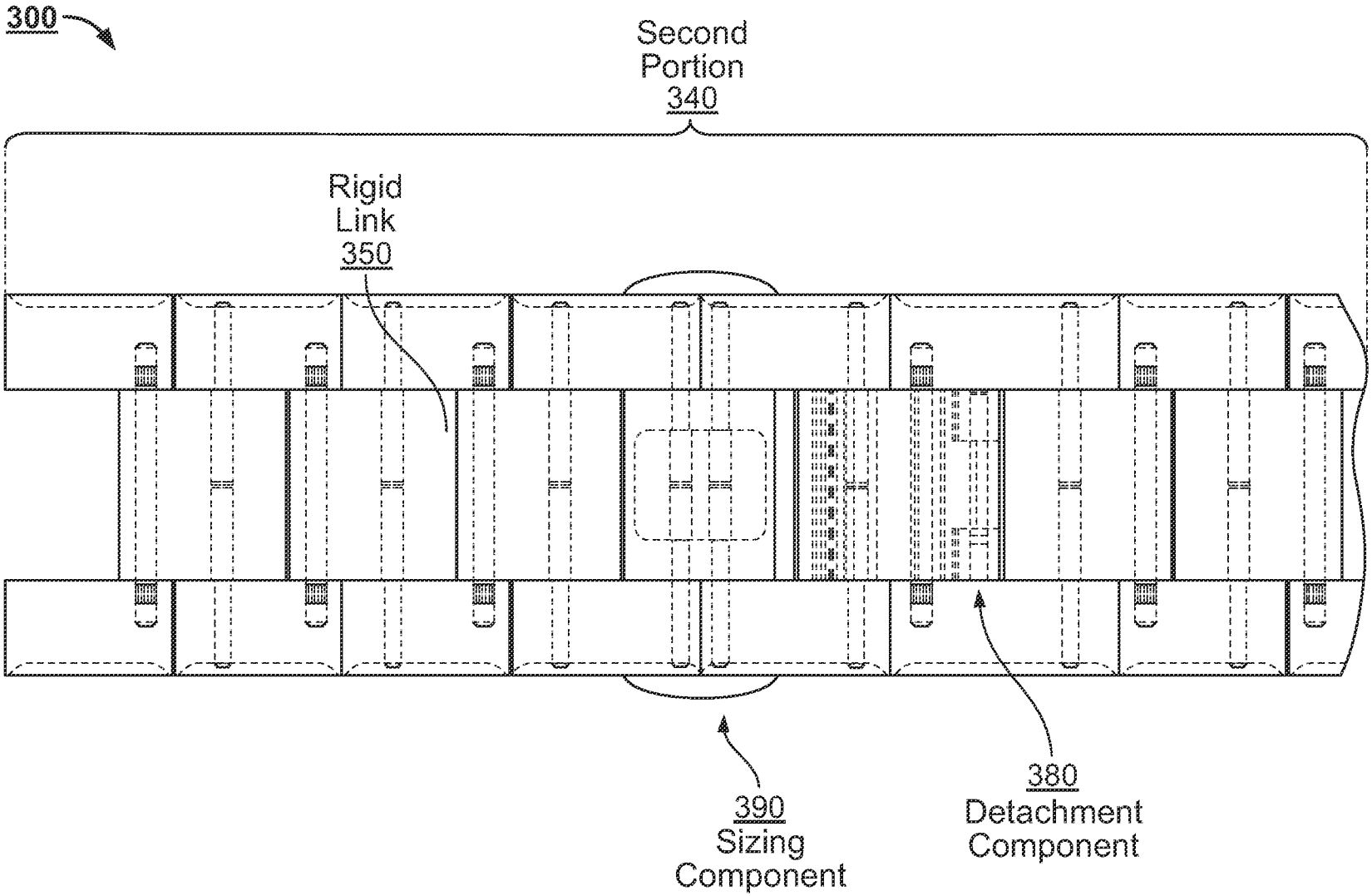
FIG. 9 is a schematic enlarged partial phantom top view of the watch band, in accordance with various embodiments of the invention.

FIG. 9 is a an enlarged partial phantom view of the top surface of the watch band 300, in accordance with an embodiment of the invention. The phantom view of the top surface includes the features discussed above with regard to FIG. 3. Specifically, the phantom top view of the watch band 300 shows some of the second portion 340, the example rigid link 350 of the second portion 340, the detachment component 380, and the sizing component 390. The first portion of the watch band 300 is not visible in FIG. 9.

Method of Use

Figure 10:
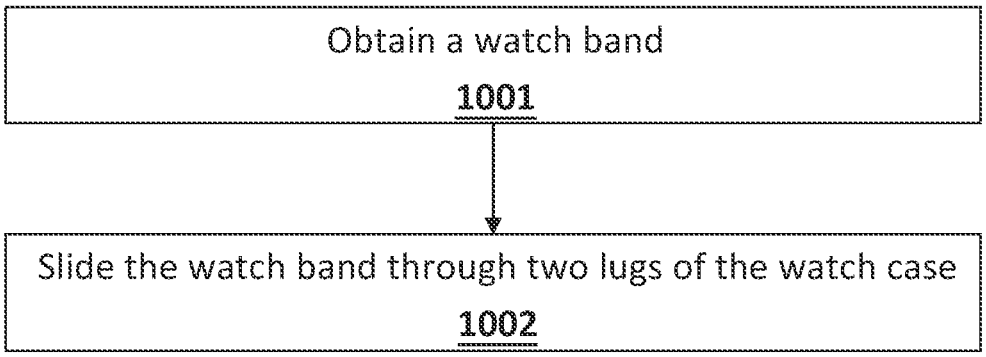
FIG. 10 is a flow chart of a method for attaching a watch band to a watch case, in accordance with various embodiments of the invention.

Embodiments of another aspect of the invention also include a method of attaching a watch band to a watch case. FIG. 10 illustrates a flow chart of a method 1000 for attaching a watch band to a watch case in accordance with various embodiments of the invention. The method 1000 includes steps of obtaining 1001 a watch band and sliding 1002 the watch band through two lugs of the watch case.

The watch band obtained in step 1001 of the method 1000 is an embodiment of the watch bands discussed in detail above with regard to FIGS. 3-9. Specifically, the watch band obtained in step 1001 includes a first portion and a second portion continuous with the first portion. The first portion of the watch band can be made of a first material. The second portion of the watch band can include a series of rigid links that are formed from a second material that is different than the first material. In some embodiments, the first material of the first portion and the second material of the second portion may be a polymer, an elastomer, a metal, a fabric, a mesh, a composite material, and/or any combination thereof.

In step 1002 of the method 1000, the watch band is slid through two lugs of the watch case such that the first portion of the watch band is located directly under a back of the watch case and such that the second portion of the watch band is adapted to wrap around a wrist of a user. In embodiments in which the first material of a portion of the watch band is a flexible material, the flexibility of the first material enables the first portion to be easily pulled through lugs of a watch case without becoming stuck.

As discussed with regard to FIGS. 3-9, in some embodiments, the watch band obtained in step 1001 of the method 1000 further includes an attachment structure that attaches the first portion to the second portion of the watch band. In general, the attachment structure can be any structure that enables a rigid band to curl around the user's wrist, e.g., a pair of offset links. In such embodiments, the method 1000 can further include coupling the offset links to the lugs of the watch case to prevent relative sliding between the watch case and the watch band.

In such embodiments in which the offset links are coupled to the lugs of a watch case, the offset links couple to the lugs of the watch case such that the first portion of the watch band is directed downwards and away from the watch case. This downward direction of the first portion of the watch band by the offset links enables a second portion of the watch band to be at the same level as the watch case when wrapped around a wrist of a user. This permits the first portion of the watch band to be neatly disposed below the watch case.

In some embodiments, the second portion of the watch band obtained in step 1001 of the method 1000 further includes a detachment component that is disposed remotely from the first portion of the watch band. In such embodiments, the method 1000 can further include detaching the detachment component prior to sliding 1002 the watch band through two lugs of the watch case. In further embodiments, the method 1000 can further include attaching the detachment component after sliding 1002 the watch band through two lugs of the watch case.

In certain embodiments in which the second portion of the watch band further includes the detachment component, the watch band can also include a sizing component that is different than the detachment component. In certain embodiments, the sizing component can be a butterfly clasp. As mentioned above, because the detachment component is both disposed remotely from the first portion of the watch band, and is different than the sizing component, the detachment component can be detached, the watch band can be pulled through the lugs of the watch case, and then the detachment component can be attached for wear by a user while permitting using a conventional technique for lengthening and shortening the watch band (e.g., a jeweler's or butterfly clasp) to facilitate donning and removal of the watch from a user's wrist.

Method of Manufacture

Figure 11:
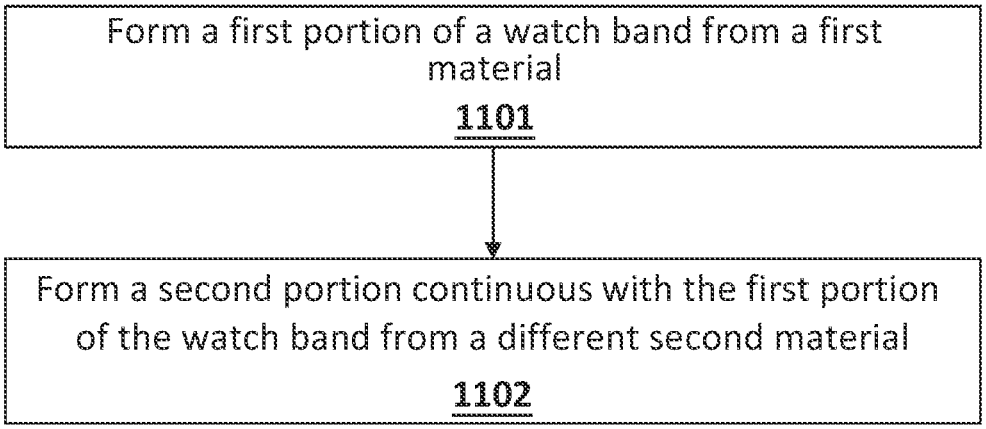
FIG. 11 is a flow chart of a method for manufacturing a watch band, in accordance with various embodiments of the invention.

Embodiments of the invention also include a method of manufacturing a single-piece watch band. FIG. 11 illustrates a flow chart of a method 1100 for manufacturing a watch band in accordance with an embodiment of the invention. As shown in FIG. 11, the method 1100 includes the steps of forming 1101 a first portion of the watch band from a first material and forming 1102 a second portion continuous with the first portion of the watch band from a different second material.

The watch band manufactured by the method 1100 is an embodiment of the watch bands discussed in detail above with regard to FIGS. 3-10. The first portion of the watch band can be adapted to be located directly under a back of a watch case, when the watch case is attached to the watch band. The second portion of the watch band can include a series of rigid links, and can be adapted to wrap around a wrist of a user, when the watch band is worn by the user.

In some embodiments, the first material of the first portion of the watch band and the second material of the second portion of the watch band may be a polymer, an elastomer, a metal, a fabric, a mesh, a composite material, and/or any combination thereof.

In some embodiments, the method 1100 further includes a step of forming an attachment structure to attach the first portion of the watch band to the second portion of the watch band. In such embodiments, the attachment structure can be a pair of offset links. The offset links can be adapted to couple to the lugs of a watch case when the watch case is attached to the watch band, to prevent relative sliding between the watch case and the watch band.

In some embodiments, forming 1102 a second portion continuous with the first portion of the watch band from a different second material further includes incorporating a detachment component disposed remotely from the first portion of the watch band. In such embodiments, forming 1102 a second portion continuous with the first portion of the watch band from a different second material can further include incorporating a sizing component that is different than the detachment component. In certain embodiments, the sizing component can be a butterfly clasp.

Additional Considerations

Upon reading this disclosure, those of skill in the art will appreciate still additional alternative structural and functional configurations based on the disclosed principles herein. Thus, while particular embodiments and applications have been illustrated and described, it is to be understood that the invention is not limited to the precise construction and components disclosed herein. Various modifications, changes and variations, which will be apparent to those skilled in the art, can be made in the arrangement, operation and details of the method and apparatus disclosed herein without departing from the spirit and scope defined in the appended claims.

As will be apparent to those of skill in the art upon reading this disclosure, each of the individual embodiments described and illustrated herein has discrete components and features which can be readily separated from or combined with the features of any of the other several embodiments without departing from the scope or spirit of embodiments of the present invention. Any recited method can be carried out in the order of events recited or in any other order which is logically possible.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements, but can include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Finally, use of "a" or "an" are employed to describe elements and components of the embodiments herein. This is done merely for convenience and to give a general sense of embodiments of the invention. This description should be read to include one or at least one and the singular also includes the plural unless it is unambiguous or clear that it is meant to be otherwise.

Each numerical value presented herein, for example, in a table, a figure, a chart, or a graph, is contemplated to represent a minimum value or a maximum value in a range for a corresponding parameter. Accordingly, when added to the claims, the numerical value provides express support for claiming the range, which may lie above or below the numerical value, in accordance with the teachings herein. Absent inclusion in the claims, each numerical value presented herein is not to be considered limiting in any regard.

The terms and expressions employed herein are used as terms and expressions of description and not of limitation and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. The features and functions of the various embodiments may be arranged in various combinations and permutations, and all are considered to be within the scope of the disclosed invention. Accordingly, the described embodiments are to be considered in all respects as only illustrative and not restrictive. Furthermore, the configurations, materials, and dimensions described herein are intended as illustrative and in no way limiting. Similarly, although physical explanations have been provided for explanatory purposes, there is no intent to be bound by any particular theory or mechanism, or to limit the claims in accordance therewith.

What is claimed is:

1. A watch band comprising:

a first portion comprising a first material adapted to be located directly under a back of a watch case;

a second portion comprising a series of rigid links formed from a different second material and adapted to wrap around a wrist of a user; and an attachment structure attaching the first portion to the second portion such that the second portion is continuous with the first portion, the attachment structure comprising at least one offset link adapted to couple to a lug of the watch case to prevent relative sliding movement therebetween.

2. The watch band of claim 1, wherein the first material and the second material are selected from the group consisting of a polymer, an elastomer, a metal, a fabric, a mesh, a composite material, and combinations thereof.

3. The watch band of claim 2, wherein the first material comprises a rubber and the second material comprises a metal.

4. The watch band of claim 1, wherein the at least one offset link comprises a pair of offset links, each offset link adapted to couple to a respective lug of the watch case.

5. The watch band of claim 1, wherein the second portion comprises a detachment component disposed remotely from the first portion.

6. The watch band of claim 5, further comprising a sizing component different than the detachment component.

7. The watch band of claim 6, wherein the sizing component comprises a butterfly clasp.

8. A method of manufacturing a watch band, the method comprising the steps of:

forming a first portion from a first material, the first portion adapted to be located directly under a back of a watch case;

forming a second portion from a different second material, the second portion comprising a series of rigid links and being adapted to wrap around a wrist of a user; and forming an attachment structure attaching the first portion to the second portion such that the second portion is continuous with the first portion, the attachment structure comprising at least one offset link adapted to couple to a lug of the watch case to prevent relative sliding movement therebetween.

9. The method of claim 8, wherein the first material and the second material are selected from the group consisting of a polymer, an elastomer, a metal, a fabric, a mesh, a composite material, and combinations thereof.

10. The method of claim 8, wherein the at least one offset link comprises a pair of offset links, each offset link adapted to couple to a respective lug of the watch case.

11. The method of claim 8, wherein the step of forming the second portion comprises incorporating a detachment component disposed remotely from the first portion.

12. The method of claim 11, wherein the step of forming the second portion further comprises incorporating a sizing component different than the detachment component.

13. The method of claim 12, wherein the sizing component comprises a butterfly clasp.

14. A method of attaching a watch band to a watch case, the method comprising the steps of:

obtaining the watch band comprising:

a first portion comprising a first material; and a second portion continuous with the first portion and comprising a series of rigid links formed from a different second material; and sliding the watch band through two lugs of the watch case, such that (i) the first portion is located directly under a back of the watch case and (ii) the second portion is adapted to wrap around a wrist of a user.

15. The method of claim 14, wherein the first material and the second material are selected from the group consisting of a polymer, an elastomer, a metal, a fabric, a mesh, a composite material, and combinations thereof.

16. The method of claim 14, wherein the watch band further comprises an attachment structure attaching the first portion to the second portion.

17. The method of claim 16, wherein the attachment structure comprises at least one offset link.

18. The method of claim 17, further comprising the step of coupling the at least one offset link to a lug of the watch case to prevent relative sliding movement therebetween.

19. The method of claim 18, wherein the at least one offset link comprises a pair of offset links, wherein the coupling step comprises coupling each offset link to a respective lug of the watch case.

20. The method of claim 14, wherein the second portion comprises a detachment component disposed remotely from the first portion.

21. The method of claim 20, further comprising, prior to the sliding step, the step of detaching the detachment component.

22. The method of claim 21, further comprising, after the sliding step, the step of attaching the detachment component.

23. The method of claim 20, wherein the watch band further comprises a sizing component different than the detachment component.

24. The method of claim 23, wherein the sizing component comprises a butterfly clasp.

* * * * *